US007980439B2

(12) United States Patent
Akiba et al.

(10) Patent No.: US 7,980,439 B2
(45) Date of Patent: Jul. 19, 2011

(54) NAILING MACHINE

(75) Inventors: Yoshitaka Akiba, Ibaraki (JP); Yoshimitsu Iijima, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 12/530,202

(22) PCT Filed: May 9, 2008

(86) PCT No.: PCT/JP2008/058993

§ 371 (c)(1),
(2), (4) Date: Sep. 4, 2009

(87) PCT Pub. No.: WO2008/143152

PCT Pub. Date: Nov. 27, 2008

(65) Prior Publication Data

US 2010/0219226 A1 Sep. 2, 2010

(30) Foreign Application Priority Data

May 11, 2007 (JP) ..... 2007-126843

(51) Int. Cl.
*B25C 1/04* (2006.01)

(52) U.S. Cl. ..... 227/8; 227/120; 227/136

(58) Field of Classification Search ..... 227/8, 120, 227/135, 136, 138, 119
See application file for complete search history.

(56) References Cited

U.S. PATENT DOCUMENTS

| | | | | |
|---|---|---|---|---|
| 4,597,517 | A * | 7/1986 | Wagdy | 227/8 |
| 6,056,181 | A * | 5/2000 | Chuang | 227/8 |
| 6,149,046 | A | 11/2000 | Ho et al. | |
| 6,199,739 | B1 | 3/2001 | Mukoyama et al. | |
| 6,913,179 | B1 * | 7/2005 | Chen | 227/8 |
| 6,938,809 | B1 * | 9/2005 | Schnell | 227/8 |
| 6,966,477 | B1 * | 11/2005 | Chien-Kuo et al. | 227/8 |
| 7,032,794 | B1 * | 4/2006 | Hung et al. | 227/8 |
| 7,059,507 | B2 * | 6/2006 | Almeras et al. | 227/8 |
| 7,150,385 | B1 * | 12/2006 | Wen | 227/8 |
| 7,182,236 | B1 | 2/2007 | Wen | |
| 7,441,683 | B2 * | 10/2008 | Ishizawa et al. | 227/120 |
| 7,506,787 | B2 * | 3/2009 | Wu et al. | 227/8 |

FOREIGN PATENT DOCUMENTS

| | | |
|---|---|---|
| JP | 08 257937 A | 10/1996 |
| JP | 3209032 | 7/2001 |

* cited by examiner

*Primary Examiner* — Scott A. Smith
(74) *Attorney, Agent, or Firm* — Kimble Intellectual Property Law, PLLC

(57) ABSTRACT

According to an aspect of the present invention, there is provided a nailing machine including: a housing; an ejection section in the housing; an activation lever provided in the ejection section to be movable inside a traveling course; a magazine holding nails; a feeder urging the nails to feed the nails; and an engagement member engaged with the feeder so that, when an amount of remaining nails becomes to a predetermined number, the engagement member is moved toward a first direction to protrude into the traveling course; wherein one of the activation lever and the engagement member includes a slope portion so that the engagement member is further moved toward the first direction through the sliding contact therebetween.

4 Claims, 6 Drawing Sheets

NAILING MACHINE

TECHNICAL FIELD

The present invention relates to a nailing machine.

BACKGROUND ART

A nailing machine, such as a nail gun, starts operation by means of synergistic combination of operation for activating a trigger placed in the vicinity of a handle and operation for pressing a lower end of a start lever located in the vicinity of an ejection section at an exit, from which a fastener such as a nail is fired, against a material subject to driving action (hereinafter called simply a "material"), such as wood. A nail in the ejection section is fired from the ejection section. The lower end of the start lever is located in the vicinity of the ejection section and pressed toward a bottom dead center by means of a spring that is supported so as to be movable between the bottom dead center at a leading end of the ejection section and the top dead center at a base end of the ejection section. Before operation of the nailing machine, the start lever is situated at the bottom dead center.

When driving operation is performed while nails are empty, the life of the nail gun is shortened, and an impact mark resultant from firing of a nail may also be left on the material, which will impair a finish. As described in Japanese Patent Number 3209032, in order to prevent such no-load firing operation, a protuberance provided at a leading end of a feeder that feeds nails to the ejection section is engaged with an engagement section of the start lever located at the bottom dead center when nails in a magazine becomes empty or comes to a predetermined number or less, thereby hindering movement of the start lever to the top dead center. The nail gun is configured such that, when movement of the start lever to the top dead center is hindered, the gun cannot be activated.

However, in the configuration described in connection with Japanese Patent Number 3209032, the amount of engagement of the engagement section with the protuberance provided at the leading end can be ensured merely to an extent that is equal to or smaller than the width of a nail. Therefore, in the case of a nail having a small width, such as a finishing nail, a sufficient amount of engagement cannot be ensured, and there has arisen a case where a no-load firing prevention mechanism fails to operate at a predetermined number of nails.

A configuration described in connection with Japanese Patent Number 3209032 is directed toward a complicate structure, wherein the width of a nail is amplified, to thus increase an amount of engagement of the protuberance located at the leading end with the engagement member. However, nails are mass-produced and involve many errors in width, and hence the errors are also amplified. When control is performed on a per-nail basis, faulty operation arises, which sometimes results in occurrence of no-load firing.

DISCLOSURE OF INVENTION

The present invention aims at providing a nailing machine that prevents occurrence of no-load firing without fail by means of a simple structure.

In order to solve the problem, the present invention provides a nailing machine including: a housing; an ejection section that is provided at an end of the housing and that defines a path through which a blade passes; an activation lever that is provided at a leading end of the ejection section to be movable inside a traveling course; a magazine that holds a plurality of nails; a feeder that urges the plurality of nails to feed the nails into the path of the ejection section; and an engagement member that is engaged with the feeder so that, when an amount of remaining nails becomes to a predetermined number, the engagement member is moved toward a first direction to protrude into the traveling course from outside thereof; wherein one of the activation lever and the engagement member includes a slope portion; and wherein the slope portion is configured so that the activation lever and the engagement member are slidably contact with each other and the engagement member is further moved toward the first direction.

According to such a configuration, the activation lever and the engagement member engage with each other by means of the slopes. Subsequently, the depth of engagement corresponding to the amount of engagement of the engagement member with the activation lever is increased with an increase in the amount of travel of the activation lever in the one direction, thereby preventing disengagement of the activation lever from the engagement member.

The engagement member may be installed in the ejection section and urged to a second direction opposite to the first direction. When the amount of remaining nails becomes the predetermined number, the feeder may contact the engagement member and the engagement member may be protruded into the traveling course.

According to such a configuration, the ejection section holds the engagement member. The ejection section must support the activation lever, and the like, and hence has rigidity. Therefore, the ejection section can hold the engagement member by means of an area exhibiting high rigidity. As a result, the engagement member can be supported reliably. When moved by the feeder, the engagement member can move over the traveling course accurately.

The engagement member may be installed in the feeder to be movable with the feeder and urged to a second direction opposite to the first direction.

According to such a configuration, since the engagement member moves along with the feeder that urges a nail, the position of the nail that is moved by the feeder and the position of the engagement member can be accurately matched with each other.

Moreover, in order to solve the problem, the present invention provides a nailing machine including: a housing; an ejection section that is provided at an end of the housing and that defines a path through which a blade passes; an activation lever that is provided at a leading end of the ejection section to be movable inside a traveling course; a magazine that holds a plurality of nails; a feeder that urges the plurality of nails to feed the nails into the path of the ejection section; and an engagement member that is engaged with the feeder so that, when an amount of remaining nails becomes to a predetermined number, the engagement member is moved toward a first direction to protrude into the traveling course from outside thereof; wherein, when the amount of remaining nails becomes to the predetermined number, the activation lever and the engagement member contact with each other and an engagement therebetween increases.

INDUSTRIAL APPLICABILITY

According to the nailing machine of the present invention, no-load firing operation can be prevented without fail by means of a simple structure.

BEST MODE FOR CARRYING OUT OF THE INVENTION

Figure 1:
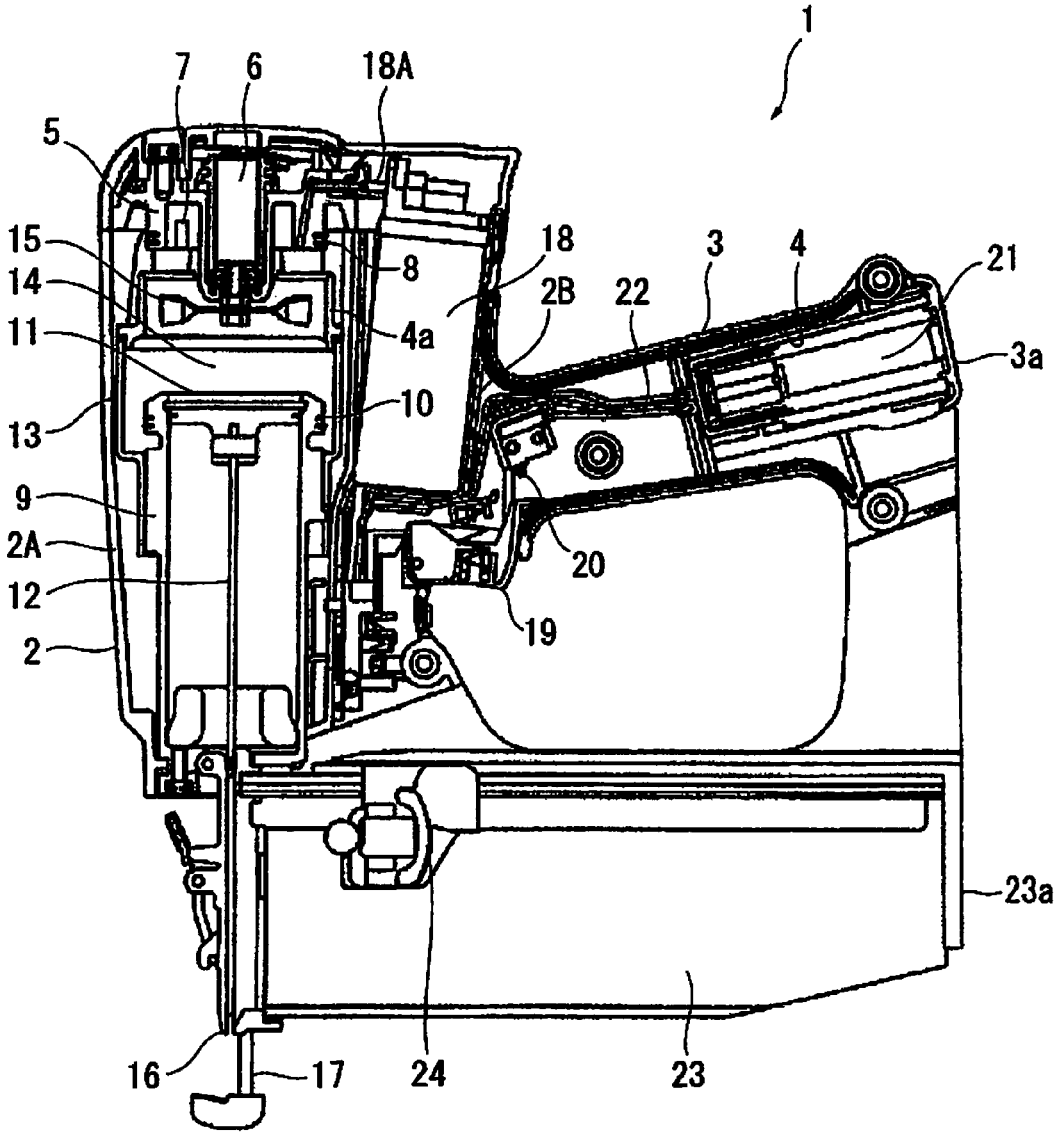
FIG. 1 is a cross-sectional view of a nail gun of a first embodiment.

A nailing machine of a first embodiment of the present invention will now be described hereunder by reference to FIGS. 1 through 5. A nail gun 1 is a combustion nail gun that performs nailing by means of taking gas as fuel; and has a housing 2 as an outer envelope. The housing 2 has a housing main body 2A; a gas cylinder housing 2B located on the side of the housing main body 2A; and a handle 3 extending from the gas cylinder housing 2B. A chamber head 5 is disposed at a position located too close to one end within the housing main body 2A. The chamber head 5 supports a motor 6 and an ignition plug 7 serving as ignition means. A head seal 8 is fitted on an outer peripheral surface of the chamber head 5. Moreover, a combustion gas channel is opened in the chamber head 5.

A cylinder 9 is fastened to a position in the housing main body 2A opposite to the motor 6, and a cylinder seal 10 is fitted to an outer peripheral surface of one side of the cylinder 9. A piston 11 serving as a power unit is provided in the cylinder 9 so as to be reciprocally slidable with respect to the cylinder 9. A driver blade 12 for driving a nail serving as a fastener extends from the piston 11 to the other side of the housing main body 2A.

A combustion chamber frame 13 capable of moving in an axial direction of the cylinder 9 is provided in the housing main body 2A. An internally peripheral surface of the combustion chamber frame 13 is sealed by the head seal 8 and the cylinder seal 10 in accordance with a traveling position of the combustion chamber frame 13. When the combustion chamber frame 13 moves toward one end of the housing main unit 2A, to thus stay at the chamber head 5, a combustion chamber 14 is defined by means of the chamber head 5, the combustion chamber frame 13, and one end face of the piston 9 by way of the head seal 8 and the cylinder seal 10. The ignition plug 7 and an open end of the combustion gas channel face the combustion chamber 14. A fan 15 fastened to a rotary shaft of the motor 6 is rotatably positioned in the combustion chamber 14.

Figure 2:
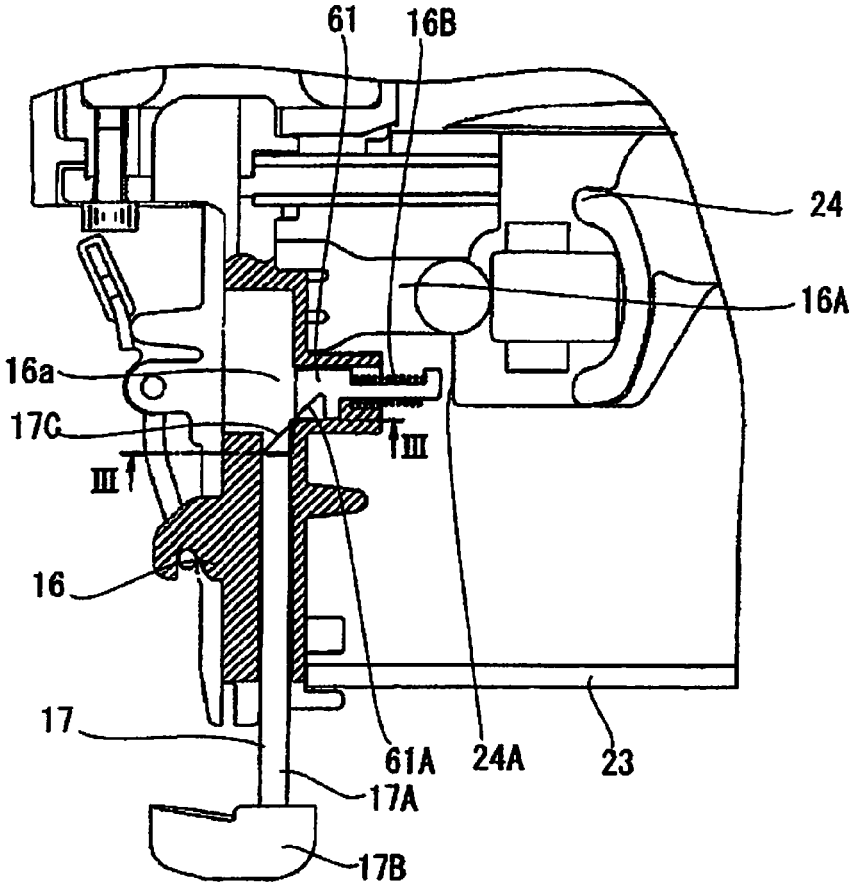
FIG. 2 is a detailed cross-sectional view of a periphery of an ejection section of the nail gun of the first embodiment.

As shown in FIGS. 1 and 2, an ejection section 16 that defines a path for enabling passage of the driver blade 12 in order to transmit power of the drive blade 12 to a nail and a magazine 23 that holds a plurality of nails to be impacted by the driver blade 12 and that feeds a nail to the path of the ejection section 16 are provided on the other end of the housing main body 2A.

A path 16*a* (FIG. 3) through which an activation member 17 to be described later moves and that serves as a traveling course and has an essentially-U-shaped cross-sectional profile is opened in the ejection section 16, and an engagement member 61 and the activation member 17 are movably supported by the ejection section. As shown in FIG. 2, the engagement member 61 is arranged in a hole orthogonal to the path 16*a* of the ejection section 16, so as to be movable in only the direction orthogonal to the path 16*a*. A first slope 61A is provided at a leading end of the engagement member facing the path 16*a*. The first slope 61A is configured in such a way that a vector normal to the first slope turns into a resultant vector formed by combination of a vector extending from a base end of the ejection section 16 to the leading end thereof and a vector extending from the leading end of the engagement member 61 to a rear end thereof. A spring 16B is interposed between the ejection section 16 and the engagement member 61, and the engagement member 61 is urged by the spring 16B so as to depart from the path 16*a*. The slope 61 is situated outside the path 16*a*, unless the engagement member 61 is pressed so as to approach the path 16*a*.

Figure 3:
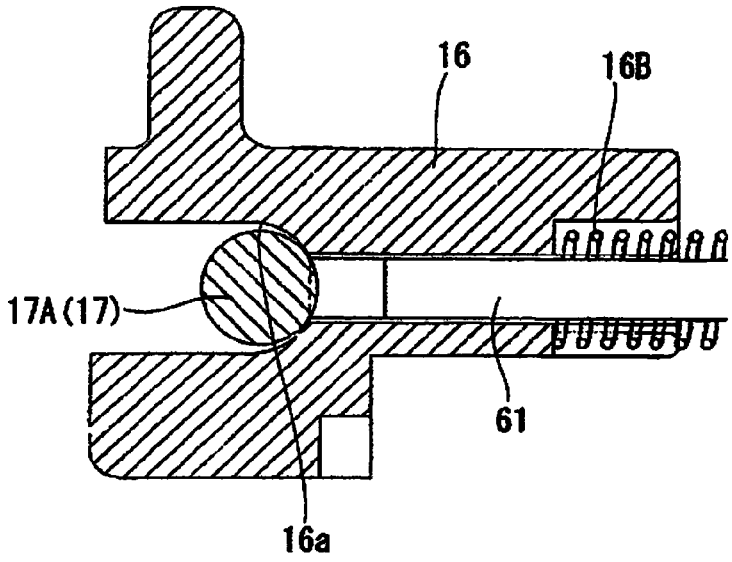
FIG. 3 is a cross-sectional view taken along line III-III in FIG. 2.

The activation member 17 is primarily made up of a shaft 17A and a contact section 17B that is located at the leading end of the ejection section 16 and comes into contact with a material, and the shaft 17A is placed in the path 16*a* in a movable manner. As shown in FIG. 3, the shaft 17A is made from a steel product, such as a music wire having an essentially-circular cross-sectional profile, and is formed so as to assume a diameter that is slightly smaller than an inner diameter of the path 16*a*.

As shown in FIG. 2, a second slope 17C is provided at a rear end of the shaft 17A (the base end of the ejection section 16). The second slope 17C is formed in such a way that a vector normal to the second slope turns into a resultant vector formed by combination of a vector extending from the leading end of the ejection section 16 to the base end thereof and a vector extending from the rear end of the engagement member 61 to the leading end thereof. Consequently, in a state where the first slope 61A is in the path 16*a*, the second slope 17C can come into a surface contact with the first slope 61A, and the respective normal directions of the first and second slopes cross the traveling course of the activation member 17 serving as a start lever. Further, the foregoing combustion chamber frame 13 is connected to the activation member 17 and configured in such a way that the combustion chamber frame 13 travels from the bottom dead center to the top dead center in conjunction with the travel of the activation member 17 from the position of the leading end to the position of the base end.

The magazine 23 is connected to the ejection section 16 and, further, to the handle 3. The magazine 23 is equipped with a feeder 24 for urging a nail toward the ejection section 16 and an unillustrated spring for urging the feeder 24. The feeder 24 is urged by the unillustrated spring, whereby a nail is fed to the ejection section 16. A claw 16A is provided at a base end of the feeder 24 facing the ejection section 16, and a nail is urged by means of the claw 16A. In the feeder 24, a contact section 24B capable of contacting the rear end of the engagement member 61 is defined in the vicinity of a base of the claw 16A. When the number of remaining nails comes to zero or a predetermined number that is greater than one, the contact section contacts the engagement member 61, thereby causing the first slope 61A to travel over the path 16*a*.

A gas cylinder 18 that stores fuel gas and that has a nozzle 18A is housed in the gas cylinder housing 2B. The nozzle 18A is provided in a fuel channel of the chamber head 5 so as to be able to selectively establish mutual communication. The nozzle is provided with an unillustrated cam that presses the gas cylinder 18 when the activation member 17 undergoes lifting force. When the gas cylinder 18 is pressed by the cam, the fuel gas from the nozzle 18A is injected into the combustion chamber 14 by way of the fuel gas channel.

The handle 3 is equipped with a trigger 19 in such a way that the trigger can be actuated by a finger, and a spark switch 20 connected to the ignition plug 7 is provided in the handle 3. A removable cell 21 is fitted in an internal space on a free-end side of the handle 3, and the cell 21 is connected to the spark switch 20 and the motor 6 by way of a wire 22.

In the foregoing configuration, when the combustion chamber frame 13 is situated at the bottom dead center, the combustion chamber frame 13 remains out of contact with the head seal 8 and the cylinder seal 10, and the internal space of the combustion chamber frame 13 is in connection with the outside. When the activation member 17 is brought into contact with the material in this state, to thus press the nail gun 1 toward the material, the combustion chamber frame 13 travels to the chamber head 5, whereupon the combustion chamber frame 13 comes into close contact with the head seal 8 and the cylinder seal 10, thereby defining the combustion chamber 14 cut off from outside air. When the combustion chamber frame 13 ascends to a predetermined position, an unillustrated sensor detects arrival of the combustion chamber frame to the position and rotates the fan 15. By means of the lifting force of the activation member 17, the unillustrated cam pushes the gas cylinder 18, whereupon the fuel gas is emitted into the combustion chamber 14 from the nozzle 18A.

When the trigger 19 is pulled while the chamber 4 stays at the top dead center, the spark switch 20 is turned on, whereupon a spark develops from the ignition plug 7. Therefore, the combustion gas is ignited in the combustion chamber 14, and the gas causes combustion and explosion, thereby urging the piston 9 toward the ejection section 16. Thus, the driver blade 12 impacts a nail situated at the ejection section 16, whereupon the nail is driven into the material.

When a nail is driven into the material, a new nail is fed into the ejection section 16 by means of the feeder 24, whereby nailing is newly performed. However, if nailing is performed when the number of nails still remaining in the magazine 23 came to zero, an impact mark of the driver blade 12 will sometimes be left on the material. In order to avoid generation of such a mark, when the number of remaining nails come to a predetermined number, the feeder 24 presses the engagement member 61, thereby moving the first slope 61A onto the path 16*a*. As a result, even when the activation member 17 is pressed against the material, the second slope 17C comes into contact with the first slope 61A, thereby preventing movement of the activation member 17 toward the base end. As a result, the combustion chamber frame 13 does not ascend to the predetermined position, and emission of gas from the gas cylinder 18 is inhibited.

Figure 4:
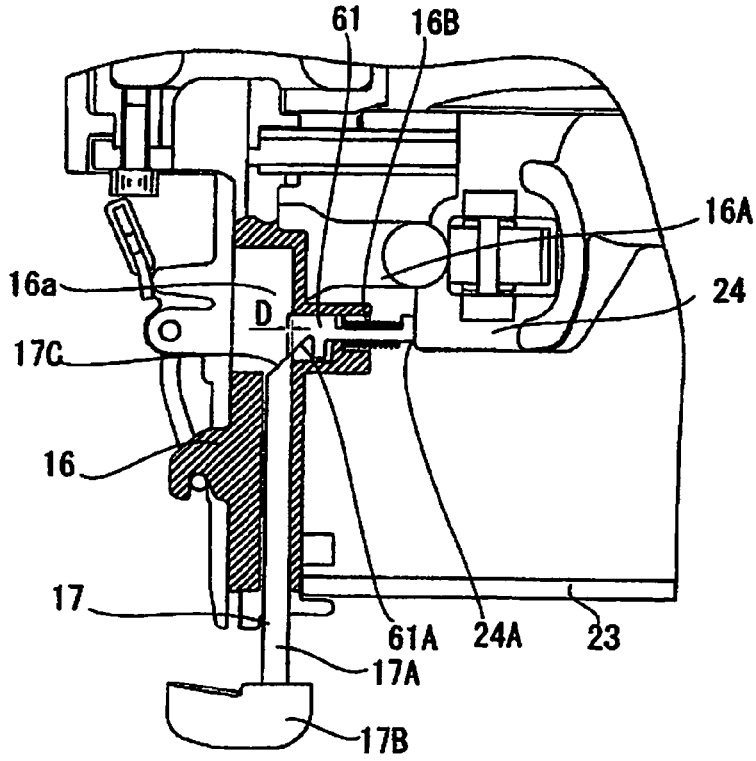
FIG. 4 is a detailed cross-sectional view of a periphery of the ejection section of the nail gun of the first embodiment (when a first slope and a second slope remain in contact with each other).
Figure 5:
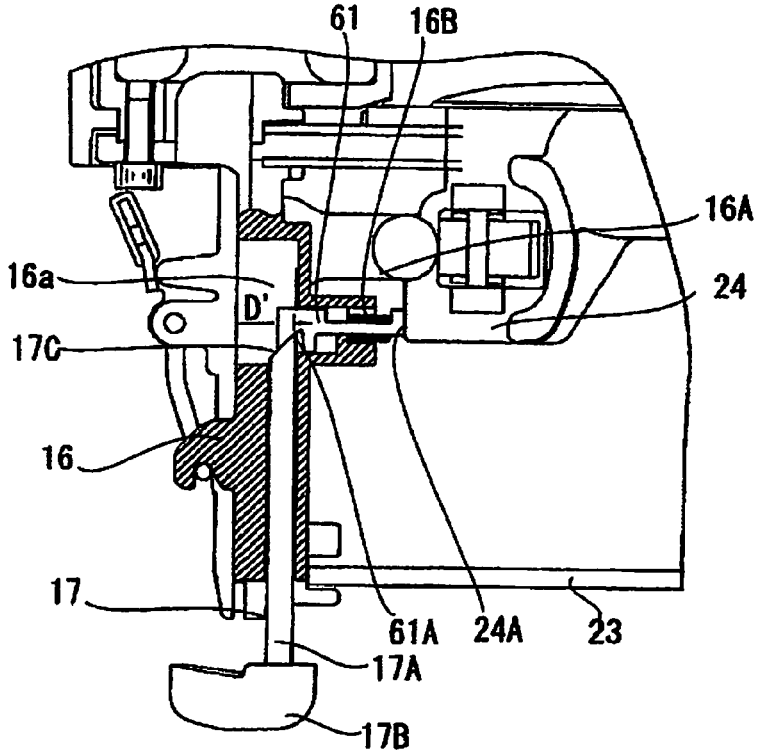
FIG. 5 is a detailed cross-sectional view of the periphery of the ejection section of the nail gun of the first embodiment (when the depth of engagement of an engagement section with an activation member is increased).

As shown in FIG. 4, the engagement member 61 and the activation member 17 contact each other by means of the first slope 61A and the second slope 17C. The activation member 17 moves toward the base end, to thus impel the first slope 61A by means of the second slope 17C, whereupon reactive force arises in the engagement member 61 in the direction of the normal. Since the engagement section 61 is incapable of moving in the direction where the activation member 17 moves (i.e., toward the path 16*a*), force develops, as a component of counterforce in the normal direction, in a direction where the engagement section 61 advances toward the path 16*a*, whereupon the engagement member 61 further moves in a direction toward the path 16*a* (FIG. 5). As a result of the engagement member 61 further moving toward the path 16*a*, an overlapping area between the first slope 61A and the second slope 17C becomes greater as shown in FIG. 5. Therefore, the depth of engagement between the engagement member 61 and the activation member 17 is increased. Accordingly, even when engagement of the activation member 17 with the engagement member 61 is small at the outset (D in FIG. 4), the depth of engagement with the engagement member 61 is increased by movement of the activation member 17 toward the base end (D' in FIG. 5), thereby hindering movement of the activation member 17 toward the base end, which would otherwise be caused when the activation member 17 is disengaged from the engagement member 61.

In the nail gun 1 of the first embodiment, the engagement member 61 is held by the ejection section 16. Since the ejection section 16 must support the activation member 17 or the like, the ejection section has rigidity and can hold the engagement member 61 by means of an area exhibiting high rigidity. Thereby, the engagement member 61 can be supported reliably. When the engagement member 61 is moved by the feeder 24, the first slope 61A can be moved over the path 16*a* accurately.

Figure 6:
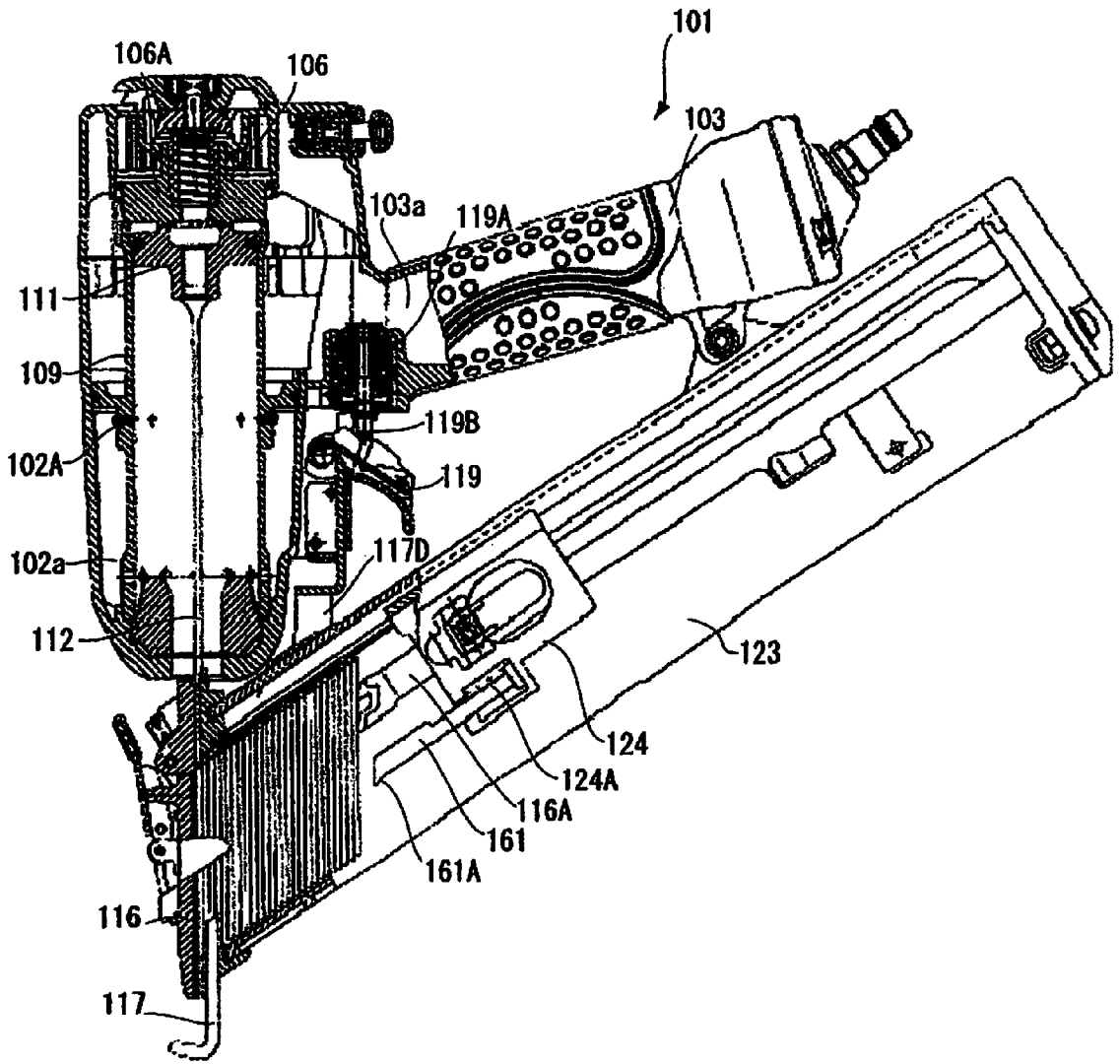
FIG. 6 is a cross-sectional view of a nail gun of a second embodiment.
Figure 7:
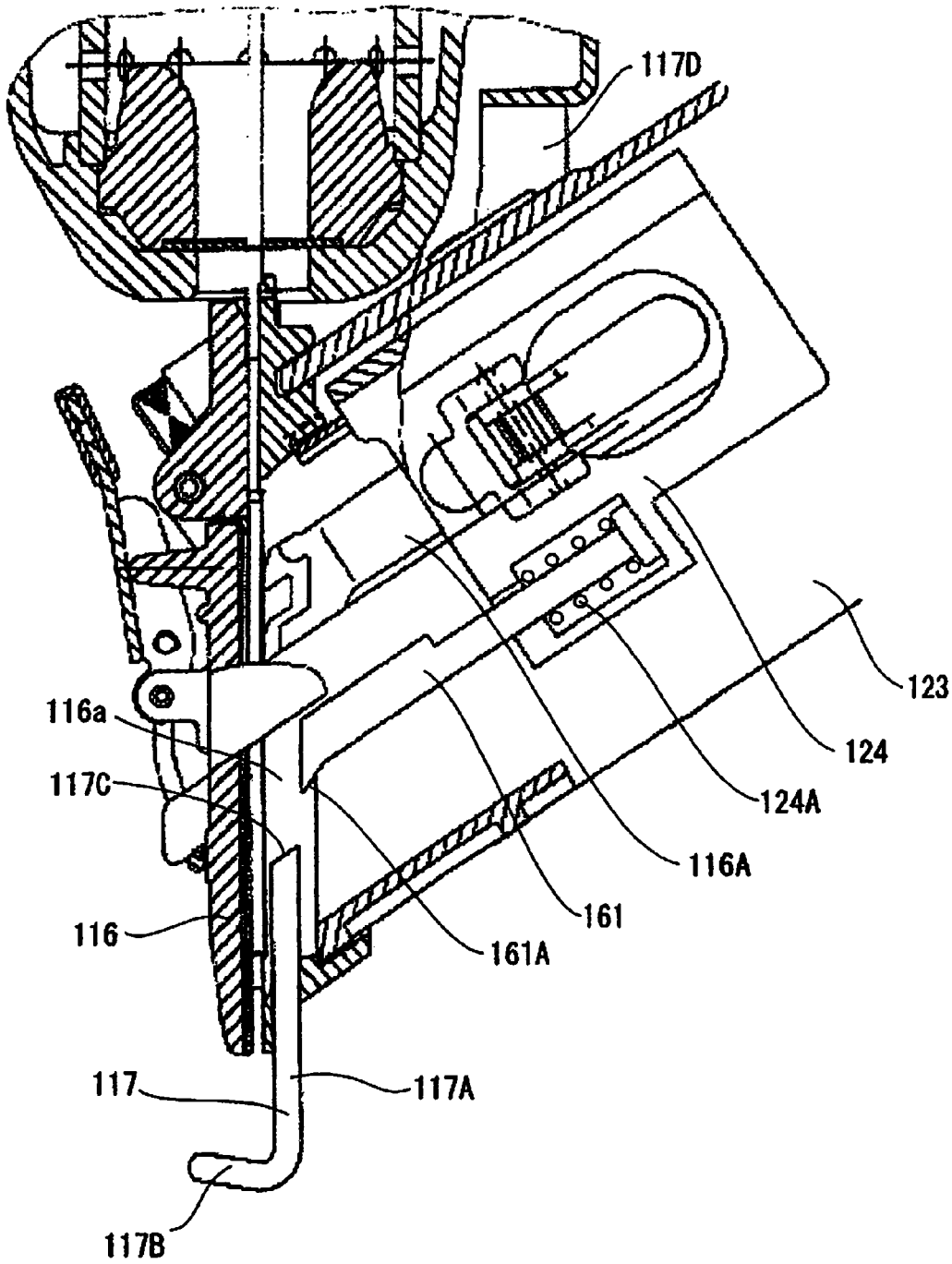
FIG. 7 is a detailed cross-sectional view of a periphery of an ejection section of the nail gun of the second embodiment.

A nailing machine of the second embodiment of the present invention will now be described by reference to FIGS. 6 through 8. A nail gun shown in FIG. 6 is a pneumatic nail gun that performs nailing by means of taking compressed air as power. A housing 102 and a handle 103 located at one side of the housing 102 are provided integrally in the nail gun. Compressed air from an unillustrated compressor is accumulated, by way of an unillustrated air hose, in a pressure accumulation chamber 103*a* formed in the handle 103 and the housing 102 of the nail gun 101. A cylindrical cylinder 109 is provided in the housing 102, and a piston 111 is provided in the cylinder 109 so as to become vertically slidable. A driver blade 112 is formed integrally on the piston 111, and a nail is driven by the driver blade 112.

A pneumatic chamber 102*a* for accumulating compressed air for returning the driver blade 112 to the top dead center is provided at a lower-end outer periphery of the cylinder 109. A non-return valve 102A is provided at the center of the cylinder 109 in an axial direction thereof, thereby creating an air path for circulating an air in only one direction from the inside of the cylinder 109 to the pneumatic chamber 102*a* outside the cylinder 109. Further, an air path normally opened to the pneumatic chamber 102*a* is formed below the cylinder 109.

A trigger 119 and a trigger valve 119A are provided at a base of the handle 103. An urging section 117D to be described later is provided in the vicinity of the trigger 119. The trigger valve 119A is placed at a location in the base of the handle 103 opposing the trigger 119. The trigger valve 119A has a plunger 119B that is pushed as a result of the trigger 119 being pulled, to thus release the path in the trigger valve 119A and enable supply of compressed air to a main valve section 106 to be described later.

The plunger 119B is built so as to be lifted both when the trigger 119 is impelled by the urging section 117D as a result of the activation member 117 being pressed against the material and when the trigger 119 is pulled.

The main valve section 106 is provided on an upper outer periphery of the cylinder 109. The main valve section 10 is equipped with a main valve 106A, and a sealed space is defined at a position above the piston 111 by means of synergistic operation of the main valve 106A and the cylinder 109. Therefore, the main valve section 106 is configured so as to be able to supply the compressed air discharged from the trigger valve 109A into the space.

An unillustrated path for enabling passage of the driver blade 112 is opened in an ejection section 116 shown in FIG.

7, and the ejection section 116 has a magazine 123 that holds a plurality of nails to be driven by the driver blade 112 and that feeds the nail to the path of the ejection section 116.

A path 116*a* extending essentially in parallel to the unillustrated path is opened in the ejection section 116. The activation member 117 is movably supported in the path 116*a*. The activation member 117 is made up of a shaft 117A inserted into the path 116*a*; a contact 117B that is located at the leading end of the shaft 117A and that contacts the material; and an urging section 117D that is situated above the ejection section 116 while being connected to the shaft 117A and that can impel the trigger 119 as mentioned previously. A second slope 117C is provided on a rear end (a base end of the ejection section 116) of the shaft 117A that serving as the other end of the shaft 117A. The second slope 117C is formed in such a way that a vector normal to the second slope turns into a resultant vector formed by combination of a vector extending from the leading end of the ejection section 116 to the base end thereof and a vector extending from the rear end of the engagement member 161 to the leading end thereof.

The magazine 123 is connected to the handle 103 as well as to the ejection section 116. The magazine 123 is provided with a feeder 124 for urging a nail toward the ejection section 116 and an unillustrated spring that impels the feeder 124. A nail is fed to the ejection section 116 as a result of the feeder 124 being impelled by the unillustrated spring. A claw 116A is provided at an end of the feeder 124 facing the ejection section 116, and the claw 116A forces a nail. Further, an engagement member 161 is disposed in the vicinity of the claw 116A in the feeder 124.

The engagement member 161 is provided on the feeder 124; extends in the same direction where the feeder 124 is urged; and is configured so as to be able to move in the same direction where the feeder 124 is urged. A spring 124A is interposed between the engagement member 161 and the feeder 124. The engagement member 161 is urged by the spring 124A in a direction opposite to the direction where the feeder 124 is impelled (a direction from the feeder 124 toward the path 116*a*). A first slope 161A is placed at the leading end of the engagement member 161 that faces the path 116*a* and that comes to a position above the path 116*a* when the number of nails in the magazine 123 comes to a predetermined number for preventing no-load firing. The first slope 161A is formed in such a way that a vector normal to the first slope turns into a resultant vector formed by combination of a vector extending from the base end of the ejection section 116 to the leading end thereof and a vector extending from the leading end of the engagement member 161 to the rear end thereof.

In the above configuration, in a case where the urging section 117D is situated at a low position, the plunger 119B is not pushed even when the trigger 119 is pulled, and hence the nail gun 101 does not operate. When the activation member 117 is brought into contact with the material in this state and when the nail gun 101 is pressed toward the material, the urging section 117D moves upward, thereby urging the trigger 119. When the trigger 119 is pulled in this state, the plunger 119B is pushed, to thus release the path in the trigger valve 119A, whereupon compressed air is delivered to the main valve section 106. The main valve 106A is actuated by the compressed air, so that an airtight chamber is created at a position above the piston 111 within the cylinder 109. The compressed air flows into the airtight chamber, whereby the piston 111 rapidly moves to the bottom dead center and a nail in the ejection section 116 is driven into the material by the driver blade 112.

Figure 8:
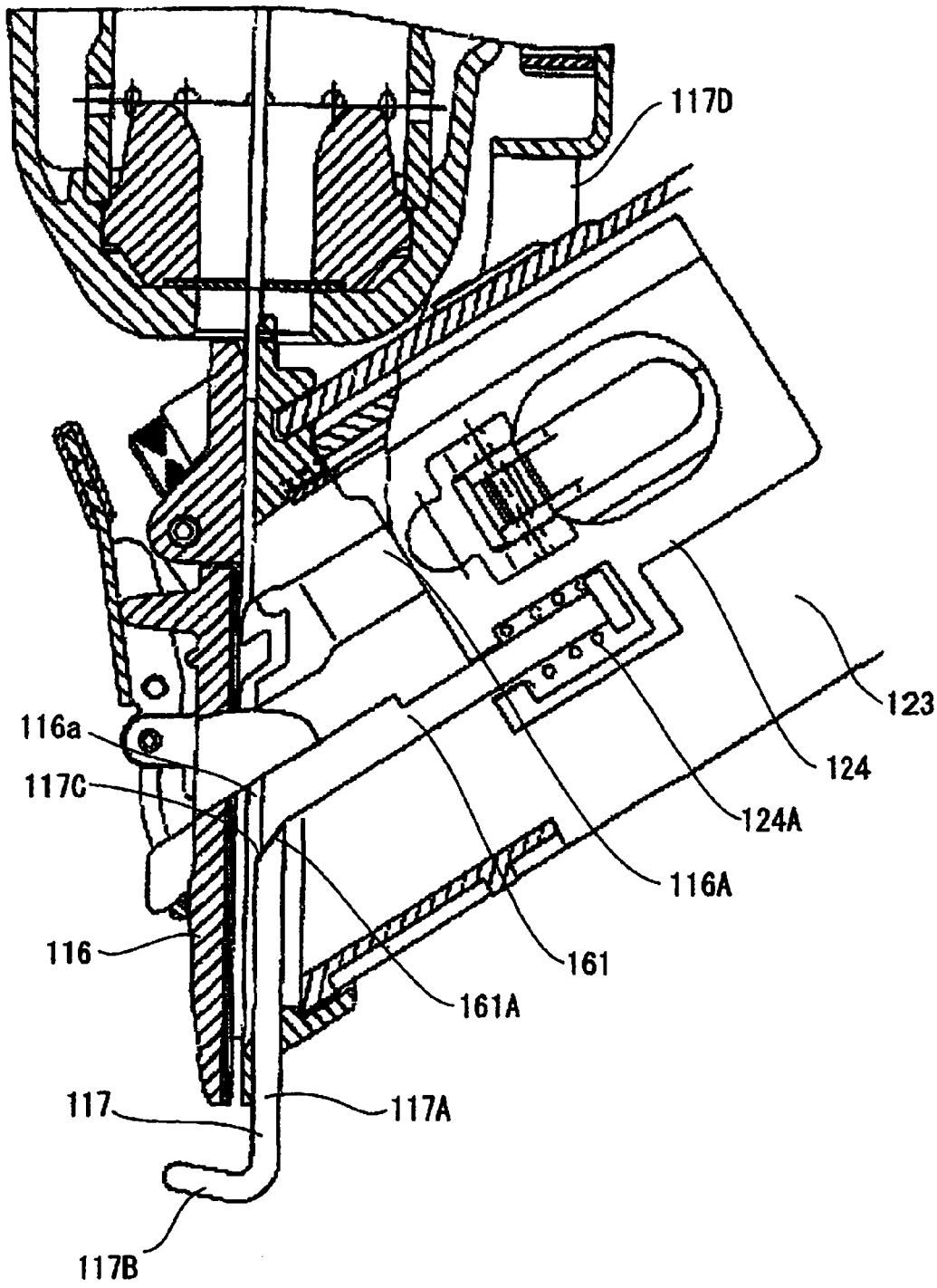
FIG. 8 is a detailed cross-sectional view of the periphery of the ejection section of the nail gun of the second embodiment (when the depth of engagement of an engagement section with an activation member is increased).

Even in the second embodiment, when the number of remaining nails comes to a predetermined number, as in the first embodiment the first slope 161A and the second slope 117C contact each other as shown in FIG. 8 in order to prevent occurrence of no-load firing operation. In relation to the first slope 161A and the second slope 117C of the second embodiment, slippage arises between the first slope 161A and the second slope 117C as in the first embodiment, whereupon the activation member 117 (the shaft 117A) moves from the leading end toward the base end. As a result, an overlapping area between the first slope 161A and the second slope 117C becomes greater, whereby the depth of engagement of the engagement member 161 with the activation member 117 is increased. Consequently, movement of the activation member 117 toward the base end, which would otherwise be caused when the activation member is disengaged from the engagement member 161, is prevented.

In the nail gun 101 of the second embodiment, the engagement member 161 moves along with the feeder 124 that feeds a nail. Hence, a nail that is moved by the feeder 124 and the position of the engagement member 161 can be accurately matched with each other. Consequently, the position of a nail that is prevented from being subjected to no-load firing and the position of the engagement member 161 can be reliably brought into agreement with each other.

In any of the embodiments, the depth of engagement of the engagement member with the activation member is increased by movement of the engagement member. However, an increase in the depth of engagement is not achieved solely by this method. The depth of engagement may also be increased by making the activation member movable or making both the engagement member and the activation member movable.

The present invention is described in connection with the nailing machine of the first embodiment where a flammable gas is taken as power and the nailing machine of the second embodiment where air is taken as power. However, the present invention is not limited to these embodiments and can also be applied to a nailing machine that takes a motor or a solenoid as a power source or that takes explosion force of an explosive as power.

The invention claimed is:

1. A nailing machine comprising:

a housing;

an ejection section that is provided at an end of the housing and that defines a path through which a blade passes;

an activation lever that is provided at a leading end of the ejection section to be movable inside a traveling course;

a magazine that holds a plurality of nails;

a feeder that urges the plurality of nails to feed the nails into the path of the ejection section; and an engagement member that is engaged with the feeder so that, when an amount of remaining nails becomes to a predetermined number, the engagement member is moved toward a first direction to protrude into the traveling course from outside thereof;

wherein one of the activation lever and the engagement member includes a slope portion; and wherein the slope portion is configured so that the activation lever and the engagement member are slidably contact with each other and the engagement member is further moved toward the first direction.

2. The nailing machine according to claim 1, wherein the engagement member is installed in the ejection section and urged to a second direction opposite to the first direction; and wherein, when the amount of remaining nails becomes the predetermined number, the feeder contacts the engagement member and the engagement member is protruded into the traveling course.

3. The nailing machine according to claim 1, wherein the engagement member is installed in the feeder to be movable with the feeder and urged to a second direction opposite to the first direction.

4. A nailing machine comprising:

a housing;

an ejection section that is provided at an end of the housing and that defines a path through which a blade passes;

an activation lever that is provided at a leading end of the ejection section to be movable inside a traveling course;

a magazine that holds a plurality of nails;

a feeder that urges the plurality of nails to feed the nails into the path of the ejection section; and an engagement member that is engaged with the feeder so that, when an amount of remaining nails becomes to a predetermined number, the engagement member is moved toward a first direction to protrude into the traveling course from outside thereof;

wherein, when the amount of remaining nails becomes to the predetermined number, the activation lever and the engagement member contact with each other and an engagement therebetween increases.

* * * * *